US006598390B2

(12) United States Patent
Chang

(10) Patent No.: US 6,598,390 B2
(45) Date of Patent: Jul. 29, 2003

(54) EASILY CONTROLLED EXHAUST PIPE

(75) Inventor: Ming-Tien Chang, Taichung (TW)

(73) Assignee: Liang Fei Industry Co. Ltd. (TW)

( * ) Notice: Subject to any disclaimer, the term of this patent is extended or adjusted under 35 U.S.C. 154(b) by 0 days.

(21) Appl. No.: 10/025,421

(22) Filed: Dec. 26, 2001

(65) Prior Publication Data

US 2003/0115861 A1 Jun. 26, 2003

(51) Int. Cl.[7] ..... F01N 7/10

(52) U.S. Cl. ..... 60/323; 60/312; 60/272; 60/322; 60/324; 181/227; 181/228; 181/249; 181/252; 181/254

(58) Field of Search ..... 60/312, 313, 314, 60/272, 322, 324; 181/227, 228, 244, 245, 252, 253, 254, 255, 249, 256

(56) References Cited

U.S. PATENT DOCUMENTS 4,840,029 A * 6/1989 Sakurai et al. ..... 60/312
4,842,096 A * 6/1989 Fujitsubo ..... 181/252
4,851,015 A * 7/1989 Wagner et al. ..... 60/313
4,909,033 A * 3/1990 Ueda ..... 60/313
4,913,260 A * 4/1990 Fallon ..... 181/254
4,939,898 A * 7/1990 Ichimura et al. ..... 60/274
6,378,471 B1 * 4/2002 Yamada et al. ..... 123/65 PE

FOREIGN PATENT DOCUMENTS

JP 02-091410 * 3/1990 ..... 60/312

* cited by examiner

*Primary Examiner*—Thomas Denion
*Assistant Examiner*—Binh Tran

(57) ABSTRACT

An exhaust pipe has a manifold; one end of the manifold is connected to a distal end of a connecting tube. Another ends of the manifold are extended with a left branch tube and a right branch tube. The left branch tube is connected to a first muffler tube and the right branch tube is connected to a second muffler tube. The feature is that an interior of a middle section of the manifold has a valve which is controlled by a controller. The valve controls the area of the opening of the left branch tube communicated with the first muffler tube and the area of the opening of the right branch tube communicated with the second muffler tube. The driver may control the variation of exhaust gas without needing to adjust the exhaust pipe. The noise may be reduced easily and the performance of acceleration is enhanced.

4 Claims, 6 Drawing Sheets

EASILY CONTROLLED EXHAUST PIPE

FIELD OF THE INVENTION

The present invention relates to an exhaust pipe, and particularly to an easily controlled exhaust pipe, wherein the driver may control the variation of exhaust gas without needing to adjust the exhaust pipe for controlling the amount of the exhaust pipe by other tools.

BACKGROUND OF THE INVENTION

For objects of environmental pollution, noise and exhaust gas from a car is limited with the areas. Moreover, the driving speed and sense of the driver have a great effect to the amount of the exhaust gas. For example, in suburb or when climbing upwards along a mountain path, the larger power is required and thus much gas is exhausted. However, as driving in a city, it is required that the noise and exhaust gas from a car must be reduced for matching the requirement of environmental protection. In general, the amount of exhaust gas can not be controlled as desired. Although in prior art, adjustable exhaust pipe have been developed, it is inconvenient since the user must leave the car to adjust the amount of exhaust gas by other tools.

SUMMARY OF THE INVENTION

Accordingly, the primary object of the present invention is to provide an exhaust pipe, the driver may control the variation of exhaust gas without needing to adjust the exhaust pipe for controlling the amount of the exhaust pipe by other tools. As a result, the noise may be reduced easily and the performance of acceleration is enhanced.

To achieve above objects, the present invention provides an exhaust pipe having a manifold; one end of the manifold is connected to a distal end of a connecting tube. Another ends of the manifold are extended with a left branch tube and a right branch tube. The left branch tube is connected to a first muffler tube and the right branch tube is connected to a second muffler tube. The feature is that an interior of a middle section of the manifold has a valve which is controlled by a controller. The valve controls the area of the opening of the left branch tube communicated with the first muffler tube and the area of the opening of the right branch tube communicated with the second muffler tube. The driver may control the variation of exhaust gas without needing to adjust the exhaust pipe. The noise may be reduced easily and the performance of acceleration is enhanced.

The various objects and advantages of the present invention will be more readily understood from the following detailed description when read in conjunction with the appended drawing.

DETAILED DESCRIPTION OF THE PREFERRED EMBODIMENTS

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
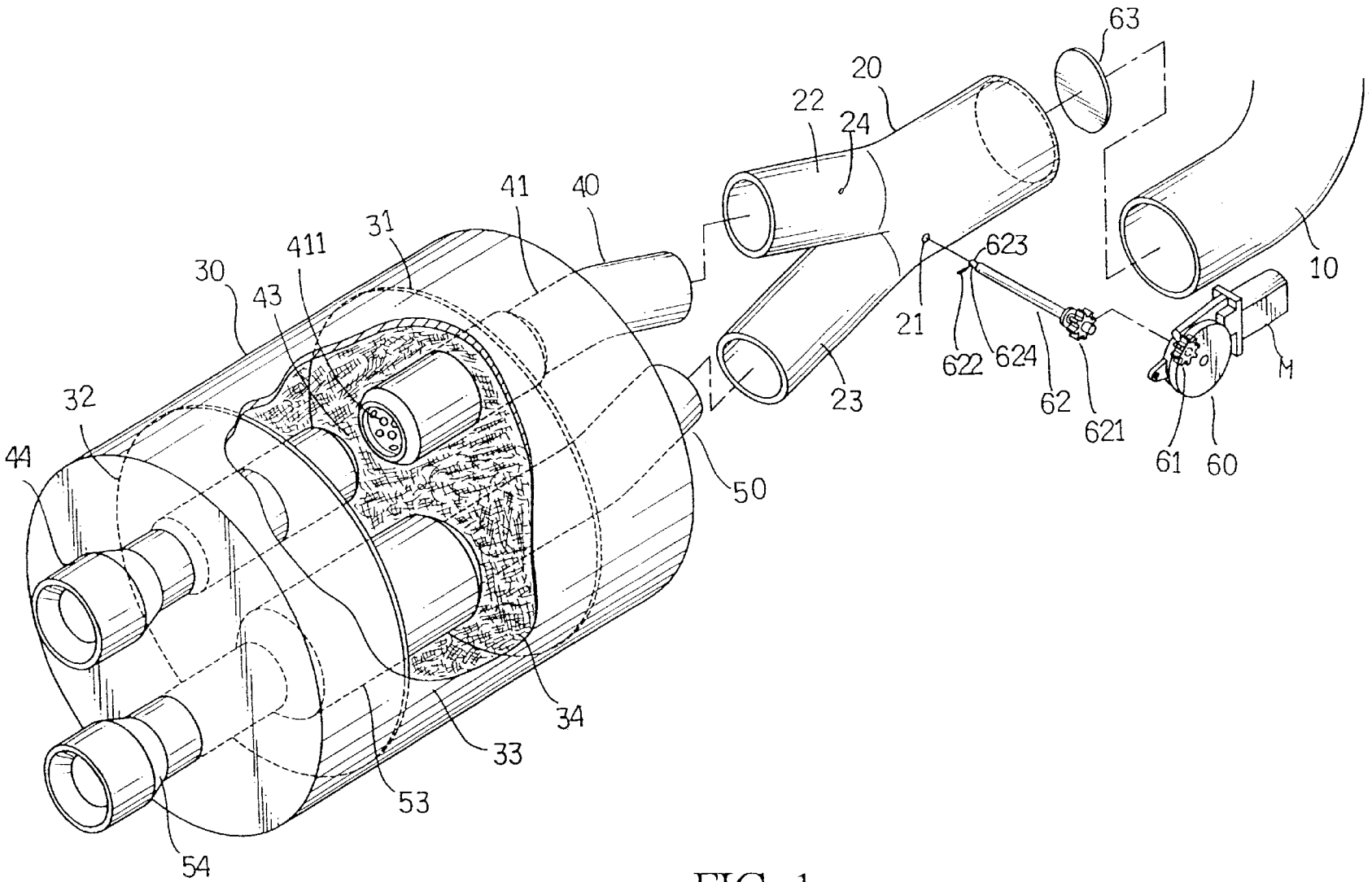
FIG. 1 is an exploded view of the present invention.
Figure 2:
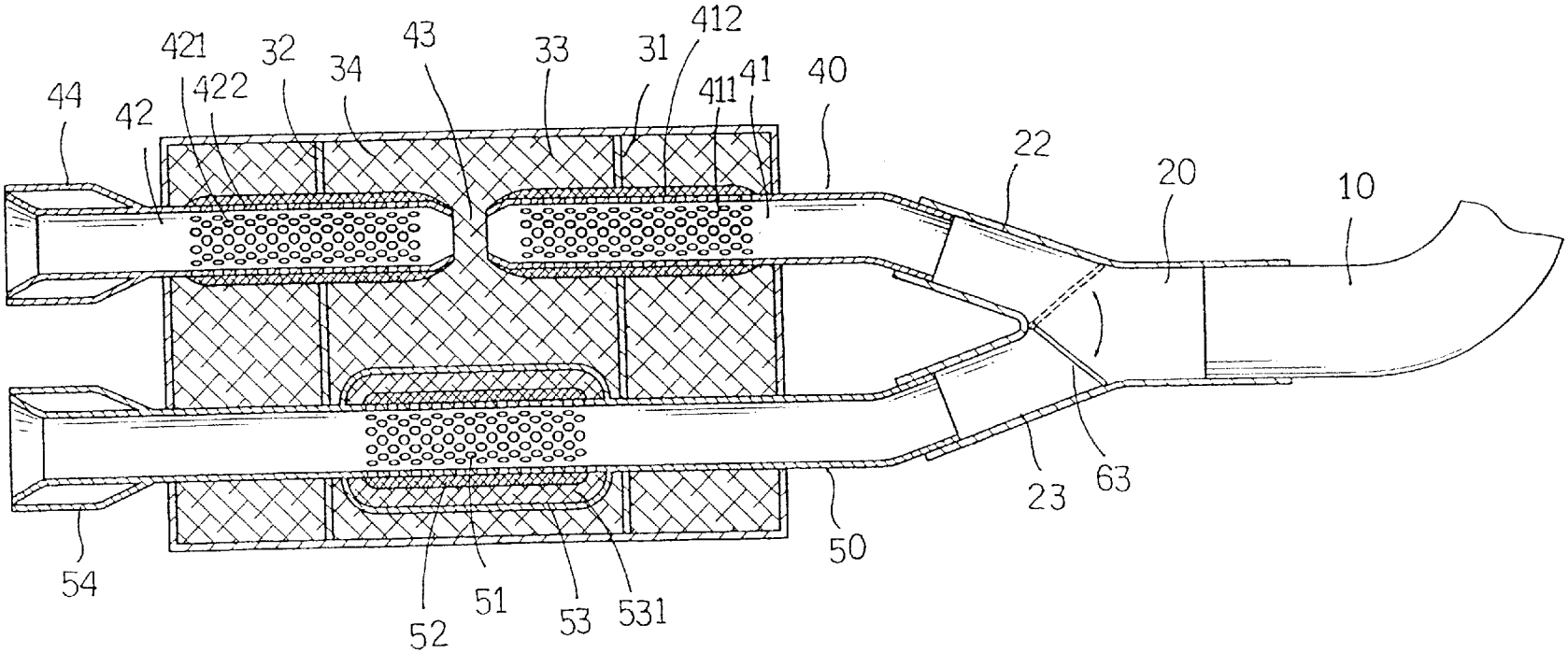
FIG. 2 is a cross sectional view of the present invention.
Figure 3:
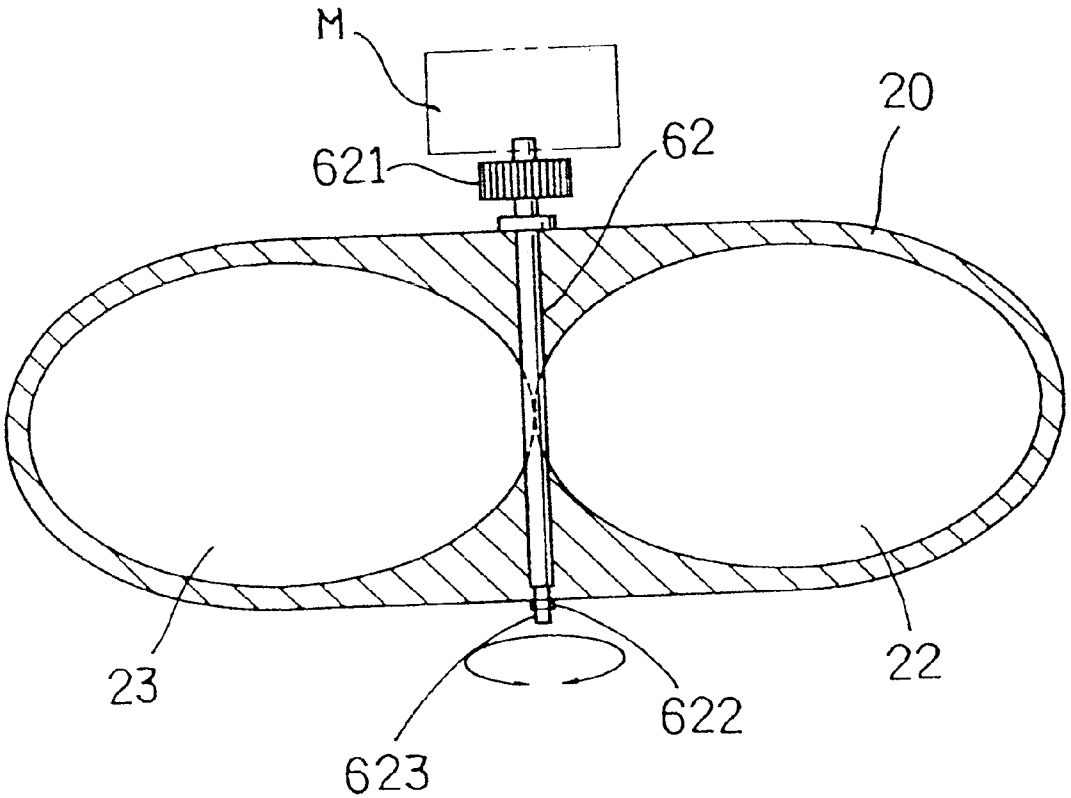
FIG. 3 is a schematic view showing the operation of a valve of the present invention.

Referring to FIGS. 1 to 3, the novel exhaust pipe of the present invention is illustrated. The exhaust pipe has a manifold 20. One end of the manifold 20 is connected to a distal end of a connecting tube 10. Another ends of the manifold 20 are extended with a left branch tube 22 and a right branch tube 23. The left branch tube 22 is connected to a first muffler tube 40 of a muffler tube 30 and the right branch tube 23 is connected to a second muffler tube 50 of the muffler tube 30.

The interior of the middle section of the manifold 20 has a valve 63 which is controlled by a controller 60. The valve 63 can control the area of the opening of the left branch tube 22 communicated with the first muffler tube 40 and the area of the opening of the right branch tube 23 communicated with the second muffler tube 50. The controller 60 is formed by a motor M to drive a gear 61. The gear 61 is engaged with a gear 621 at one end of a rotary shaft 62. The rotary shaft 62 passes through the though hole 21 at a middle section of the manifold 20. A smaller stepped shaft 622 at another end of the rotary shaft 62 passes through the though hole 24 at another side of the manifold 20 and then a pin 622 is inserted into a pin hole 624 on the stepped shaft 623 so as to position the rotary shaft 62. The middle section of the rotary shaft 62 is connected with a lower edge of the valve 63.

The interior of the muffler tube 30 is installed with a front isolating plate 31 and a rear isolating plate 32. The two isolating plates have two though holes for being inserted by the first muffler tube 40 and the second muffler tube 50. Thereby, a noise eliminating chamber 33 is formed between the front isolating plate 31 and the rear isolating plate 32. Glass fibers 34 are filled in the noise eliminating chamber 33.

The first muffler tube 40 is formed by a two sectional tubes which are tubes 41, and 42. The spacing of the two tubes 41, 42 are formed as a flowing region 43. The two tubes are formed with noise eliminating holes 411, 421. Stainless steel and cotton structures 412, 422 enclose the noise eliminating holes 411, 421. A distal end of the tube is connected with a distal tube 44.

The diameter of the second muffler tube 50 is slightly larger than the first muffler tube 40. The middle section thereof is installed with a plurality of noise eliminating holes 51. Stainless steel and cotton structure 52 encloses the noise eliminating holes 51. An outer tube 53 encloses the middle section of the second muffler tube 50. Large amount of glass fibers 531 are filled between the outer tube 53 and the middle section. A distal end of the second muffler tube 50 is connected to a distal tube 54.

In the following the conditions of the present invention will be described.

Figure 4:
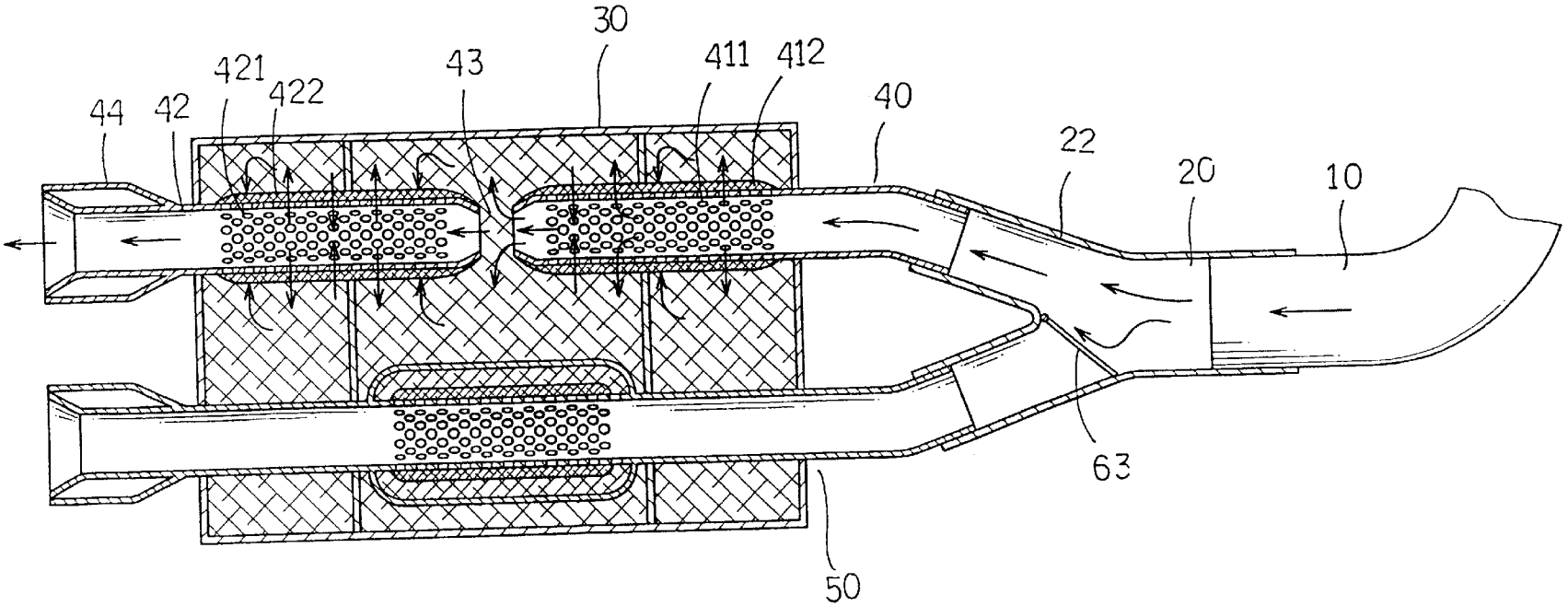
FIG. 4 is a schematic view showing the operation of the present invention.

1. In normal condition (referring to FIG. 4), since the valve 63 is between the manifold 20 and the right branch tube 23, the exhaust gas will be hindered by the valve 63 so that the exhaust gas will flow into the first muffler tube 40. A part of the gas flows through the noise eliminating holes 411 and thus passes through the glass fibers 412 and the stainless steel and cotton structure 34 so that the gas flows in the noise eliminating chamber 33 so as to become slower effectively. A part of the gas enters into the tube 42 of first muffler tube 40 from the flowing region 43. The exhaust gas is exhausted from the stainless and cotton structure 422 through the tube 42. Therefore, the flowing path of the exhaust gas is prolonged and the gas is filtered so as to reduce noises and pollution (so that the exhaust gas matches the requirement).

Figure 5:
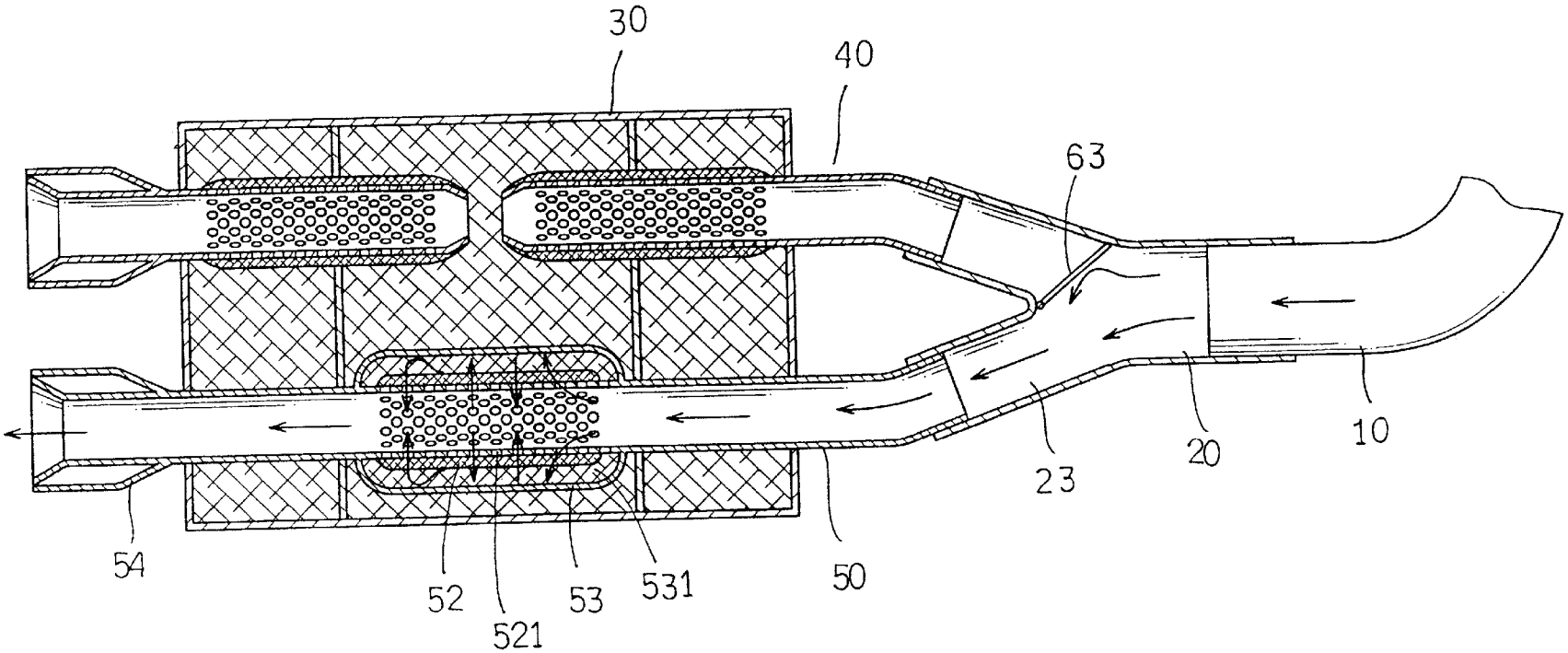
FIG. 5 is another schematic view showing the operation of the present invention.
Figure 6:
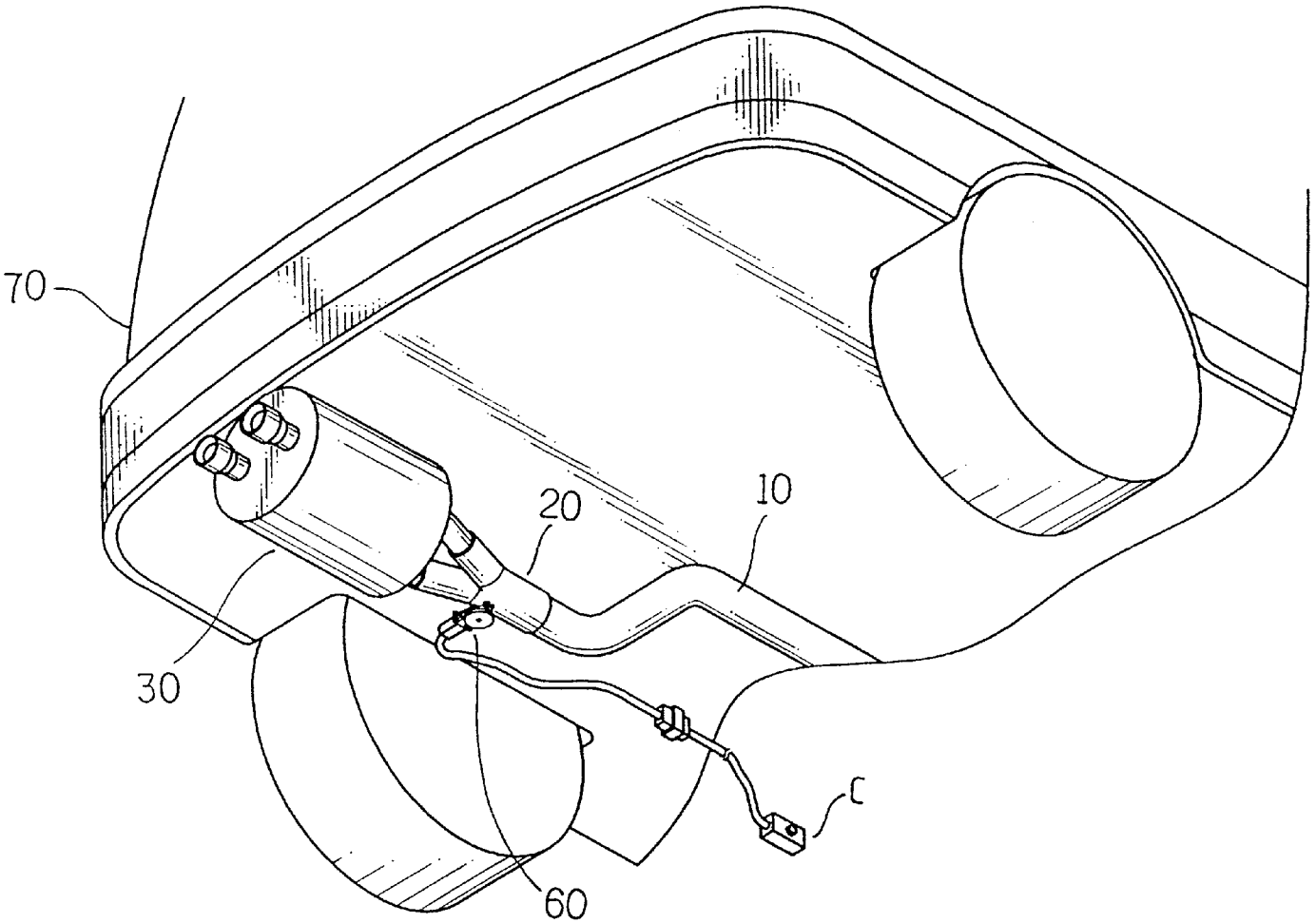
FIG. 6 is a schematic view showing that the present invention is installed to a car.

When it is desired to promote the performance of the acceleration of a car 70, for example the car drives along a superhigh way, or in suburb, or on the mountain path (referring to FIGS. 5 and 6). It is only necessary to switch a switch. The controller 60 is connected to a switch 60 in the driver's seat through a connecting wire. Thereby, the actuation, stoping, forward and backward rotations of the motor M is controlled. The rotation of the gear 61 will drive the valve 63 to rotate so as to seal the path from the first muffler tube 40 to the right branch tube 23 so that the valve 63 is hindered. Then gas enters into the second muffler tube 50. The gas in the outer tube 53 flows through the noise eliminating holes 51, stainless steel and cotton structure 531, and glass fiber 52 and thus is filtered and then is exhausted, or part of gas will be exhausted directly from the second muffler tube 50. Thereby, the speed is increased.

By the present invention, the driver may control the variation of exhaust gas without needing to adjust the exhaust pipe for controlling the amount of the exhaust pipe by other tools. As a result, the noise may be reduced easily and the performance of acceleration is enhanced.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An exhaust pipe having a manifold; one end of the manifold being connected to a distal end of a connecting tube;

another ends of the manifold being extended with a left branch tube and a right branch tube; the left branch tube being connected to a first muffler tube of a muffler tube and the right branch tube being connected to a second muffler tube of the muffler tube; characterized in that:

an interior of a middle section of the manifold has a valve which is controlled by a controller; the valve controls an area of an opening of the left branch tube communicated with the first muffler tube and an area of an opening of the right branch tube communicated with the second muffler tube;

a diameter of the second muffler tube is slightly larger than that of the first muffler tube; a middle section thereof is installed with a plurality of noise eliminating holes; stainless steel and cotton structures encloses the noise eliminating holes; an outer tube encloses a middle section of the second muffler tube; a large amount of glass fibers are filled between the outer tube and the middle section; a distal end of the second muffler tube is connected to a distal tube.

2. The exhaust pipe as claimed in claim 1, wherein an interior of the muffler tube is installed with a front isolating plate and a rear isolating plate; a noise eliminating chamber is formed between the front isolating plate and the rear isolating plate; and glass fibers are filled in the noise eliminating chamber.

3. The exhaust pipe as claimed in claim 1, wherein a first muffler tube is formed by a two sectional tubes; the spacing of the two tubes are formed as a flowing region; the two tubes are formed with noise eliminating holes; stainless steel and cotton structures enclose the noise eliminating holes; a distal end of the tube is connected with a distal tube.

4. The exhaust pipe as claimed in claim 1, wherein in the controller, a motor drives a gear, a switch is used to control the actuation, stopping, forward and backward rotation of the motor; a shaft of the gear has a smaller stepped shaft passes through the though hole at another side of the manifold and then a pin is inserted into a pin hole on the stepped shaft so as to position the shaft; a middle section of the shaft is connected with a lower edge of the valve.

* * * * *